United States Patent [19]

Psaras et al.

[11] 4,102,349

[45] Jul. 25, 1978

[54] METHOD AND APPARATUS FOR MOISTURIZING TOBACCO STEMS

[75] Inventors: John D. Psaras; Leroy R. Sachleben, both of Louisville, Ky.

[73] Assignee: Brown & Williamson Tobacco Corporation, Louisville, Ky.

[21] Appl. No.: 705,741

[22] Filed: Jul. 15, 1976

[51] Int. Cl.[2] ..... A24B 3/00; A24B 3/12

[52] U.S. Cl. ..... 131/135; 131/140 R

[58] Field of Search ..... 131/133 R, 134, 135, 131/136, 137, 138, 140 R, 140 P; 302/17, 20, 66, 11-13; 239/559, 367, 683

[56] References Cited

U.S. PATENT DOCUMENTS

| | | | |
|---|---|---|---|
| 3,204,641 | 9/1965 | Jones | 131/140 R |
| 3,690,328 | 9/1972 | Quarenghi | 131/140 R |
| 3,742,961 | 7/1973 | Waller | 131/138 |
| 3,786,818 | 1/1974 | Johnson | 131/140 P |

*Primary Examiner*—Robert W. Michell
*Assistant Examiner*—V. Millin
*Attorney, Agent, or Firm*—William J. Mason; Charles G. Lamb

[57] ABSTRACT

Whole tobacco stems are uniformly moisturized by opening the cellular structure of the stems and inducing moisture to permeate the opened cellular structure. By an initial and simultaneous application of water and steam, the cellular structure of the stems is opened, and moisture permeates the structure to a first induced moisture content. Thereafter, the stems are equilibrated with the moisture diffusing throughout the cross-section of the stems. Subsequent to equilibration, the stems are moisturized to a second induced moisture content by initially applying water to the stems and thereafter a mixture of water and steam.

43 Claims, 4 Drawing Figures

46
51
50
48
10
18
16
Water
Water
18
Upper Conveyor Control
Control System
19
12
30
44
32
Steam
38
4
4
Water
20
14
30
12
34
44
Steam
28
40
Water
22
55
30
12
36
44
Steam
42
52
Water
24
30
54
56
Lower Conveyor Control

METHOD AND APPARATUS FOR MOISTURIZING TOBACCO STEMS

BACKGROUND OF THE INVENTION

The present invention relates to the art pertaining to the moisturizing or conditioning of whole tobacco stems.

The relatively high cost of the tobacco components for smoking articles renders it desirable to fully utilize all of the tobacco leaf including the stems and veins of the leaf. Exemplary of prior patents disclosing processes for converting tobacco stems to usable products are U.S. Pat. Nos. 3,204,641 to Jones; 3,690,328 to Quarenghi; and 3,734,104 to Buchanan et al.

As used in the present disclosure, the term "stem" shall include both the stem as such, as well as the veins separable from the remainder of the tobacco leaf.

Typically, the prior art processes commence by moisturizing the stems to prepare the stems for rolling. The prior art, which will be specifically compared to the present invention, moisturizes the stems prior to rolling by applying water and steam to the stems. The water and steam are normally applied separately and directly to the stems. The subsequent rolling process opens the structure of the stem allowing further moisturization and expansion of the rolled stem subsequent to its comminution into a plurality of particles. It has also been discovered that the cellular structure of whole tobacco stems can be opened thermally by the simultaneous application of water and steam to whole tobacco stems.

Irrespective of the means used to open the cellular structure of the whole tobacco stems, the characteristics of the final product are significantly affected by the moisture content of the stems during comminution and expansion. While different processes may utilize stems at various total moisture contents, the processes are exceptionally responsive to seemingly minor variations in moisture content either from stem to stem or throughout the cross-section of the respective stems.

Moisture content significantly affects the mechanical properties of the stems and, therefore, their response to any mechanical process, for example, the comminution of the stems to particles.

In addition, moisture content can also affect the expansion of the particles. Particles having moisture contents outside the desired range of moisturization may, at least partially, contract after expansion, thereby reducing the cost effectivness of the utilization of such tobacco products.

Most commercial processes expanding tobacco stems achieve moderate success in communicating and expanding whole tobacco stems; however, the prior art processes are significantly improved by process steps that moisturize whole tobacco stems to a substantially uniform moisture content. The uniformity of moisturization enhances process performance by allowing such processes to be adjusted to optimal process parameters without concern for wide variations in moisture content that place significant portions of the stems outside the desired range of operation.

The fact that processes for utilization of tobacco stems involve millions of pounds of input material and product makes uniformity of moisturization commercially significant, since even minor improvements in process performance result in significant economic benefits.

The volume of material treated in such processes places constraints on the moisturization processes. It is desirable to treat the stems on a continuous basis, or, if continuity is not possible, with interruptions to continuity being as short as possible. Prior art processes attempt to achieve uniformity of moisturization by lengthy (e.g., 30 minutes) equilibration or bulking steps. The length of such steps seriously reduces the commercial viability of such processes.

Non-uniform moisturization of whole tobacco stems in processes for expanding the stems normally results in two serious process effects.

First, the generation of increased amounts of fine particles or meal occur during communication of the stems. This undesirable by-product can be utilized in other tobacco reclamation processes, but such materials cannot be directly incorporated into smoking articles and thus further processing costs are incurred. Again, the magnitude of the input materials makes significant by-product generation economically burdensome and reduces the cost effectiveness of stem expansion processes.

Second, the stems may incompletely expand or expand and then at least partially contract. Either of those two effects reduces the cost effectiveness of such processes.

Therefore, it is the primary object of the present invention to uniformly moisturize whole tobacco stems throughout the cross-section of the respective stems and from stem to stem.

It is an additional object of the invention to provide uniformly moisturized tobacco stems that can be comminuted without generation of excessive amounts of particulate fines or meal.

It is another object of the invention to produce uniformly moisturized whole tobacco stems suitable for comminution without the necessity for lengthly soaking or bulking steps.

It is also an object of this invention to condition whole tobacco stems to the extent that rolling or crushing of the stems is not necessarily required prior to comminution, but the stem conditioning of this invention can be utilized prior to rolling.

Further objects and advantages of the invention will be set out in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the invention, as embodied and broadly described herein, the invention comprises method and apparatus for opening the cellular structure of the whole tobacco stems and concurrently inducing moisture into the structure to achieve a first induced moisture content of from 20 to 40 weight percent. All moisture contents throughout the specification are expressed on an included basis. The moisturized stems are then equilibrated for a relatively short time and thereafter moisturized to a second induced moisture content by initially applying water to the stems and thereafter a mixture of water and steam.

In the embodiment of the invention where the stems are rolled subsequent to their initial moisturization the first induced moisture content is preferably in the range of from 26 to 30 weight percent. Where the stems are not rolled the preferred moisture content is in the range of from about 30 to 34 weight percent.

Preferably, the stems are moisturized to a second induced moisture content by passage through a vertically disposed conduit. Water is applied to the stems when the stems are in the upper portion of the conduit and a mixture of water and steam is applie to the stems within the lower portion of the conduit.

Preferably, the water first applied to the stems in moisturizing the stems to the second induced moisture content is at a temperature of approximately 180° F.

It is also preferred that the final uniform moisture content of the stems be in the range of from 30 to 60 weight percent. In the embodiment of the invention where the stems are subsequently rolled to open the cellular structure, the preferred final uniform moisture content is 34 to 36 weight percent. In the embodiment of the invention eliminating the rolling step, the preferred final uniform moisture content is from 42 to 44 weight percent.

To achieve the foregoing objects and in accordance with the invention, as embodied and broadly described herein, the invention also comprises an apparatus for uniformly moisturizing whole tobacco stems having a substantially vertical conduit having upper and lower portions, said lower portions having permeable walls, said conduit receiving and passing said stems therethrough. Means are provided for feeding said stems to the upper portion of said conduit and for conveying said stems from the lower portion of said conduit. In addition, means are associated with the upper portion of said conduit for applying water to said stems within said upper portion. Means defining a plurality of chambers surround the lower portion of said conduit, said chambers being located in vertically spaced positions and include means for supplying water and steam to said chambers. Means are interposed between said supply means and the outer surface of said conduit for preventing localized application of said steam to said outer surface.

BRIEF DESCRIPTION OF THE DRAWINGS

The accompanying drawings constitute a part of the specification and illustrate one embodiment of the invention and, together with the description, serves to explain the principles of the invention.

DESCRIPTION OF THE PREFERRED EMBODIMENT

Figure 3:
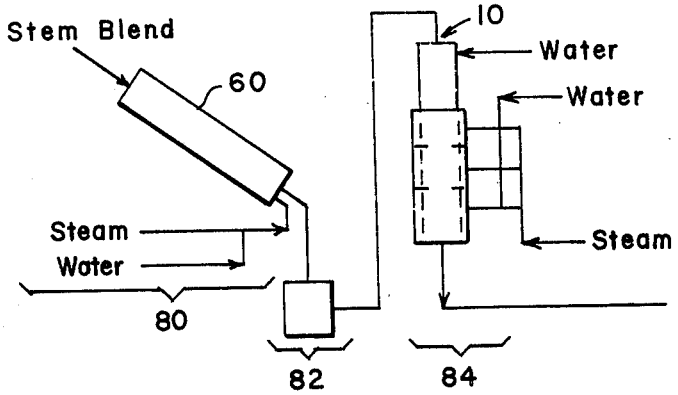
FIG. 3 is a schematic representation of the three basic sections of the preferred moisturizing system.

The present invention is a method and apparatus for uniformly moisturizing whole tobacco stems. Referring to FIG. 3, the system for moisturizing whole stems of the preferred embodiment is basically comprised of a first moisturizing section 80, an equilibration section 82 and a second moisturizing section 84.

In accordance with the invention, the apparatus includes means for opening the cellular structure of the whole tobacco stems.

In the preferred embodiment the cellular structure of the tobacco stems is opened and moisture concurrently added in the first moisturization section 80. The moisturization section 80 is comprised of an inclined cylinder 60, shown in detail in FIG. 2, wherein steam is applied to the stems as they pass through cylinder 60 to open their cellular structure and water is concurrently applied to moisturize the stems to a first induced moisture content.

Figure 2:
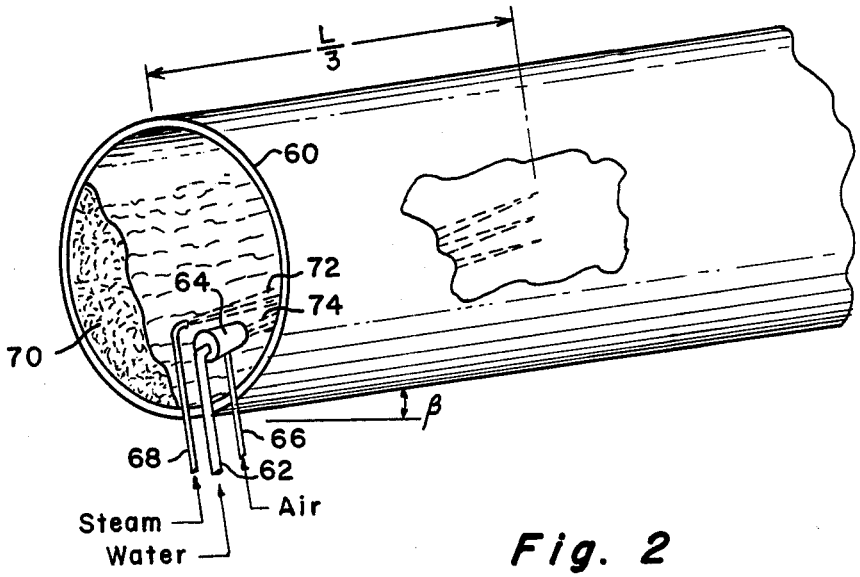
FIG. 2 is a partial perspective view of a cylindrical member for thermally opening the cellular structure of the stems.

The inclination and rotation of the cylinder 60 cause the stems 70 passing through the cylinder to mass in a portion of the cross-sectional area of the cylinder and assume a profile like that shown in FIG. 2. Preferably, the cylinder is rotated about 20 revolutions per minute. The angle of the cylinder from the horizontal, shown as angle $\beta$, is preferably 7°. The location and configuration of the mass depends upon the speed of rotation of the cylinder, its angle of inclination, the flow rate of the material and the physical characteristics of the material.

The cylinder 60 includes separate conduits for the introduction of the water and steam. The water conduit 62 includes a nozzle 64 receiving compressed air through air conduit 66 to form a water spray 74 from the nozzle 64. The cylinder 60 further includes a steam conduit or pipe 68 that directs steam 72 to the interior of the cylinder.

It is, therefore, preferred that the nozzle 64 and the steam pipe 68 direct the water 74 and the steam 72 only onto the mass of stems. It is further preferred that the water and steam be directed to a limited portion of the stems rather than the entire length of stems moving through the cylinder. In the preferred embodiment of the invention, the water and steam are directed to the same limited portion of the stems. This portion is located approximately at a distance one-third of the length of the cylinder from the lower end.

Treatment of the stems in cylinder 60 opens their cellular structure, and induces moisture such that the stems exit the lower end of the cylinder at a first induced moisture content.

In accordance with the invention, and depicted schematically in FIG. 3, the apparatus includes means for equilibrating the first induced moisture content to the entire thickness of the stem. The equilibration step is accomplished in section 82 by diffusing water throughout the thickness of the stem so the stem is uniformly moist, i.e., being without a gradient of water content across its thickness.

Preferably, this is accomplished by confining the stem in a closed container for a time in excess of 10 minutes and most preferably about 15 minutes. If the equilibration step is carried out for a time less than the preferred value, inherent variations in stem structure and size will prevent uniform diffusion of the water into the interior portions of the stem and induce variations in the moisture content of the stems.

Such variations result in non-uniform properties of the final product which, in turn, create difficulties in subsequent use of the product. Equilibration in excess of 15 minutes yields no further benefits and lengthy equilibration steps adversely affect process economics. The equilibration step (also known in the art as bulking) is preferably carried out in a moisture impervious closed container, and one skilled in the art needs no specific teaching as to the configuration of the bulking apparatus in order to practice the invention.

In accordance with the invention, means are provided for feeding the equilibrated tobacco stems to the means for further moisturization. As here embodied and depicted in FIG. 1, the apparatus includes a partially enclosed conveyor 46 having a conveyor belt 48 delivering the stems to conduit 10. In this manner, stems are transported from enclosure 50 of the equilibration section 82 to the second moisturization section depicted in FIG. 3 as 84.

In accordance with the invention, means are provided for moisturizing the equilibrated stems to a second induced moisture content by initially applying water and then a mixture of water and steam to the stems.

Figure 1:
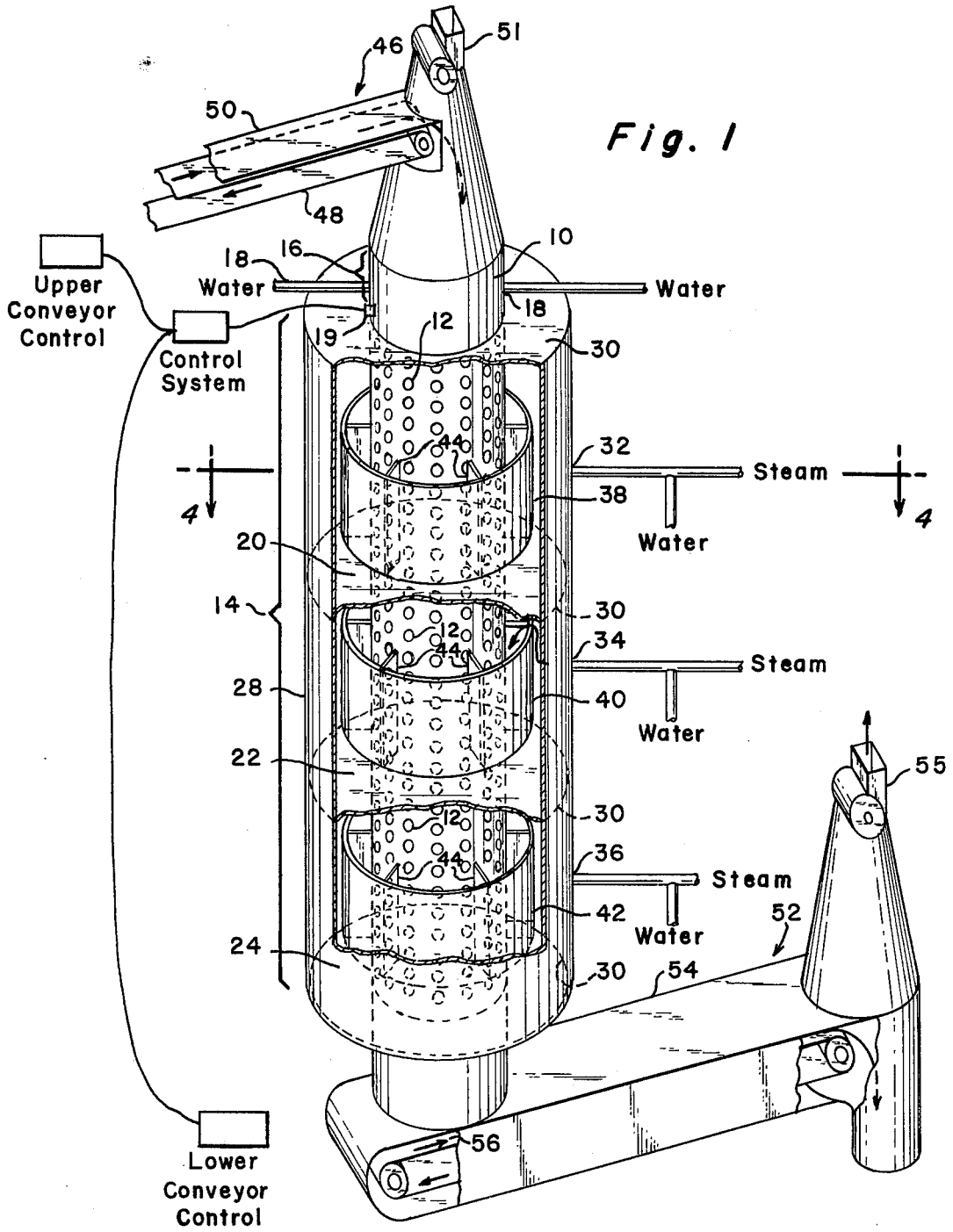
FIG. 1 is a partial cross-sectional view of one embodiment of the present invention utilizing a vertical conduit to moisturize the stems to the second induced moisture content.

As here embodied and depicted in detail in FIG. 1 and schematically in FIG. 3, the moisturizing means in the second moisturization section 84 includes the conduit 10 for receiving the stems from the equilibrating section 82. Conduit 10 includes an upper portion 16 and a lower portion 14. The lower portion 14 has permeable walls embodied herein as a cylindrical conduit with a plurality of orifices 12 disposed along its length. It is the function of the orifices 12 to permit passage of a mixture of water and steam there through and onto the stems as the stems move through the lower portion 14 of the conduit 10.

In accordance with the invention, the apparatus includes means for applying water to the stems in the upper portion 16 of the conduit 10. As here embodied, the upper portion 16 of the conduit 10 has a pair of opposed water inlets 18.

The exact configuration of the water inlets is not known to be critical; however, particular success has been experienced where an opposed pair of water inlets apply water to the stems in the form of a spray. It is further preferred that the spray be applied to the stems as they free fall within upper portion 16 of conduit 10. In that manner, the water is most uniformly applied to the equilibrated stems. The rates of moisture addition will be more fully disclosed in a description of the operation of the preferred embodiment. Generally, it is desired to increase the moisture content of the stems approximately 10 weight percent by the application of a water spray to the stems within the upper portion 16 of the conduit 10 when moisturizing the stem for subsequent treatment without rolling. When a subsequent rolling step is to occur, the moisture content increase in portion 16 is approximately 5 weight percent.

As here embodied, means associated with the lower portion 14 of the conduit 10 apply a mixture of water and steam to the stems as they move through the conduit.

Preferably, the stems move downwardly through the conduit 10 in the form of a column or plug of stems. For purposes of this disclosure, a column of stems means a plurality of stems that have accumulated within the conduit to the point where adjacent stems are lying on top of each other. This is in contrast to the preferred condition of the stems in the upper portion 16 of the conduit 10 where they free fall while receiving additional moisture.

The height of the column of stems is maintained by controlling either the rate of stem input to the conduit 10 or the rate of conveying the stems from the lower extremity of the conduit. As shown in FIG. 1, the secondary moisturizing means includes a detector, preferably a photocell 19, below the water applying means for detecting the upper extremity of the column of stems. FIG. 1 also includes a schematic representation of a control system which may either interact with the input conveyor 46, the lower or exit conveyor 52, or both to control the height of the column of stems within the conduit 10.

As here embodied, the vertical cylindrical conduit 10 defines a plurality of orifices 12 that render conduit 10 permeable to the passage of the mixture of water and steam. The mixture is applied to the outer surface of the conduit and passes through orifices 12 to permeate the stems within the conduit. Preferably, the orifices are circular and when circular, comprise approximately 35 percent of the surface area of the lower portion 14 of the conduit 10.

The configuration of the orifices 12 in the walls of the conduit 10 is not known to be critical. This embodiment of the invention is operable when the orifices are of sufficient size to allow access of the mixture of water and steam to the column of stems while confining the stems to the interior of the conduit 10.

Preferably, the cylindrical conduit 10 is surrounded along its length by a plurality of chambers, depicted in FIG. 1 as upper chamber 20, middle chamber 22 and lower chamber 24. The chambers are each in flow communication with the stems in the conduit 10 through orifices 12. The chambers 20, 22 and 24 are preferably defined by a concentric member 28 surrounding the conduit 10 and a plurality of radially disposed separating members 30 connecting the conduit 10 and the concentric member 28.

Means for introducing the mixture of water and steam to the chambers and thereby supplying steam and water to the outside surface of the conduit 10 is depicted schematically as mixture inlets 32, 34 and 36. Preferably, each of the inlets receive a mixture from independently adjustable sources of water and steam allowing different mixtures to be introduced to different chambers. As will be more fully disclosed when the operation of the preferred embodiment is described, the sources of steam and water are adjusted to apply progressively less moisture to the stems as the stems pass through the conduit 10.

While the preferred embodiment utilizes a common source of steam at similar pressure (15 psig) at each chamber, the steam sources could be independent. It is the function of the steam applied to the stems in the lower portion 14 of the conduit 10 to heat the stems as they pass through the conduit to further promote the additional infusion and diffusion of moisture.

The present preferred embodiment also utilizes water at a temperature in the range of from 40° to 70° F, but varies the flow rate of the water to different portions of the conduit 10 to progressively decrease the amount of water applied to the stems as the stems progress through the conduit.

In accordance with the invention, there is provided means interposed between the means for supplying the steam and the outer surface of the conduit for preventing localized application of steam to the outer surface. Localized application of steam to the conduit and the stems within it results in nonuniform heating of the stems which, in turn, results in nonuniform moisturization.

Figure 4:
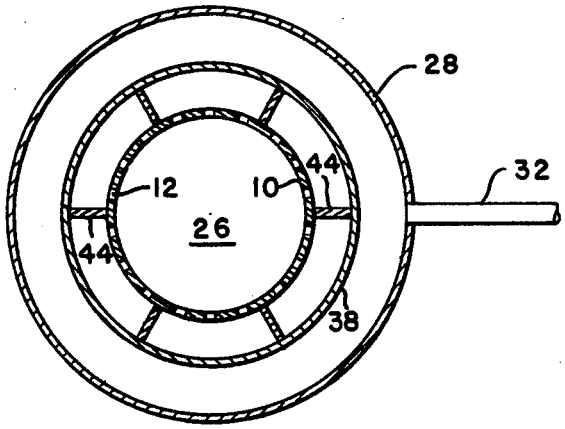
FIG. 4 is a cross-sectional view of the embodiment of FIG. 1 taken along the line 4—4.

As here embodied and depicted in FIGS. 1 and 4, baffles 38, 40 and 42 are interposed between the mixture inlets 32, 34 and 36 and the outer surface of the conduit 10. While the mixture inlets in the embodiment depicted simultaneously introduce both water and steam, the baffles need only be interposed between the steam inlet and the conduit 10. Local nonuniform application of water quickly diffuses to a uniform moisture content due to the porous nature of the column of stems and the stems themselves. By contrast, the response of the stems to moisturization is temperature dependent and local heating of the stems by localized application of steam to the conduit will cause nonuniform moisturization of the stems.

The baffles of the preferred embodiment have a height less than the chamber and allow the flow of steam around the baffles. Excess water is drained, by means not shown, from each of the separating members 20, 22 and 24.

In accordance with the invention, means in communication with the conduit, receive the uniformly moisturized stems at the second induced moisture content and convey the stems to other operations.

As here embodied, the receiving or exit conveyor 52 conveys the stems from the lower extremity of the conduit 10 on a conveyor belt 56. The conveyor belt 56 is within an enclosure 54 that retains the moisture within the stems.

Preferably, there are provided means for extracting steam from the conduit 10 as the stems pass therethrough. As here embodied, the enclosed lower conveyor 52 includes a blower 55 in flow communication with the enclosure 54. It is also preferred that apparatus include steam-extracting means on the input portion of the conduit 10 and as here embodied, blower 51 is disposed to extract steam therefrom. The induced flow of steam through the column of stems within the conduit 10 promotes uniform heating within the column of stems.

Operation of the preferred embodiment indicates, and it is preferred, that the stems become progressively hotter as they progress toward the outlet of conduit 10. The induced flow of steam through the stem column is not intended to eliminate the temperature gradient along the length of the conduit but to eliminate local non-uniform heating within the stem column.

OPERATION OF THE PREFERRED EMBODIMENT

The process of the present invention is depicted schematically in FIG. 3. The process opens and moisturizes tobacco stems to a first induced moisture content in the moisturization section 80 of the schematic apparatus depicted in FIG. 3. The moisturization section 80 is preferably comprised of means of treating the stems to the first induced moisture content.

The stems are introduced to the upper end of the inclined cylinder 60 and the rotation and inclination of the cylinder mixes and transports the stems through the cylinder in a mass generally having the profile shown in FIG. 2. Typically, the cylinder 60 is rotated at approximately 20 rpm. Steam is applied to a portion of the stems to open their cellular structure. In the preferred embodiment, the steam pipe 68 directs steam onto a limited and predetermined portion of the stems located about ⅓ of the length of the cylinder 60 from its lower end. Preferably, the steam is saturated steam at a pressure of approximately 140 psig which has a temperature of approximately 360° F. The simultaneous application of water and steam preferably heats the stems to a temperature in the range of from 120° to 160° F in reaching the first induced moisture content.

After the cellular structure of the stems has been opened, the stems are moisturized to a first induced moisture content of from 20 to 40 weight percent. While the first induced moisture content should be within the broad range of from 20 to 40 weight percent, it is preferably less than 36 weight percent and most preferably from about 30 to 34 weight percent for non-rolled stems and 26 to 30 weight percent for rolled stems.

In the embodiment of FIG. 2, the first induced moisture content is attained by spraying the stems in the cylinder 60 by means of a nozzle 64 that directs a water spray 74 to a portion of the stems within the cylinder.

Subsequent to the attaining of the first induced moisture content, the moisture content of the stems is equilibrated. The equilibration of the stems diffuses the moisture throughout the cross-section of the stems. As was previously disclosed, it is preferred that the equilibration be carried out by confining the moisturized stems in a moisture impervious container approximately 15 minutes. This step occurs in equilibration section 82 as shown schematically in FIG. 3.

The equilibrated stems are thereafter moisturized to a second induced moisture content in the range of from 30 to 60 weight percent by initially spraying the stems with water and thereafter applying a mixture of water and steam to the stems. Preferably, the second induced moisture content is in the range of from about 42 to 44 weight percent for stems that thereafter will not be rolled prior to cutting and 34 to 36 weight percent for stems that will be rolled prior to cutting. Whole tobacco stems moisturized to these levels exhibit superior final properties when further processed to form a particulate expanded tobacco filler material. Specifically, the fill power of stems are significantly superior to stems with higher and lower moisture contents.

The moisturization of the equilibrated stems to the second induced moisture content is accomplished in the secondary stem moisturizing section depicted as 84 in FIG. 3. A specific preferred embodiment of a secondary moisturizing section 84 is shown in FIG. 1. The description of the process and its preferred steps is most conveniently accomplished by reference to this embodiment of the invention.

As previously described, the stems are initially subjected to the direct application of water. The water is normally applied as a spray in the upper portion 16 of the conduit 10. It is preferred that the water applied to the stems be at an elevated temperature and 180° F has been found to be particularly advantageous. It is also preferred that the stems be free falling within upper portion 16 of conduit 10 during the direct application of water to the stems. It is further preferred that the application of the water spray increase the moisture content of the equilibrated stems approximately 10 percent when it is desired to achieve a second induced level of 42 to 44 weight percent. A correspondingly lesser amount is required when attempting to achieve a second induced level of 34 to 36 weight percent.

Subsequent to the application of a water spray to the stems within the upper portion 16 of the conduit 10, the stems are subjected to the simultaneous application of water and steam while passing through the lower portion 14 of the conduit 10. Preferably, the stems move through the lower portion 14 of the conduit 10 as a column or plug of stems at a speed resulting in the stems having an average residence time of from about 2 to 6 minutes within the lower portion 14 of the conduit.

The lower portion 14 of conduit 10 includes at least one chamber surrounding the conduit from which a mixture of water and steam is applied to the stems through the orifices 12. Where a plurality of chambers are utilized, it is possible to vary the properties of the mixtures introduced from the respective chambers.

Particular success has been experienced where the steam and water mixture is applied from three spacially separate chambers along the length of the conduit. In this manner the moisture content of the stems is trimmed systematically to the precise desired level. The uppermost portion of conduit 10 receives a mixture from chamber 20 at a flow rate sufficient to increase the moisture content of the stems approximately 3 weight percent for non-rolled stems and one (1) weight percent for rolled stems. The middle portion of conduit 10 receives a mixture from chamber 22 at a flow rate sufficient to cause an increase in the moisture content of the stems if approximately 1 percent for non-rolled stems and less than 1 percent for rolled stems. The lowermost portion of conduit 10 receives a mixture from chamber 24 at a flow rate sufficient to increase the moisture content of the stems less than one percent and achieve the desired final induced moisture content.

This sequential moisturization of the stems results in a more uniform moisture content within individual stems and less variation of moisture content from stem to stem. Operation of the present invention in this sequence generally results in the stems having less than a 2 percent variation from the average moisture content desired.

Use of the process while monitoring the ultimate disposition of the moisture from the steam and water indicates the steam does not contribute significantly to the moisture retained in the stems, but facilitates the introduction, diffusion and retention of the applied water. Preferably, the steam applied in conduit 10 is not superheated. The rate of steam application to the embodiment of FIG. 1 is, of course, dependent on the flow rate of stems through the device. At a stem flow rate of approximately 1000 pounds of dry (moisture content present in the stems excluded from the weight) stems per hour, 500 pounds of steam at about 23 psia are supplied. Since the water applied to the stems is primarily responsible for changes in the moisture content of the stems, the flow rate of water into the device is determined by the moisture content of the stems at their entrance to the conduit 10, the desired final moisture content, and the flow rate of stems through the conduit.

Preferably, the mixture of steam and water is applied to the stems at a temperature in the range of from 200° to 212° F. In such a temperature range, the moisturization of the stems can be carried out at commercially attractive rates while maintaining superior uniformity of the moisture within the stems.

EXAMPLES

EXAMPLE 1

This example illustrates typical values for the water additions (in gallons per thousand pounds of stems) for the various operations of the invention on both rolled and non-rolled stems:

| | Non-Rolled | Rolled |
|---|---|---|
| Water addition to cylinder 60 | 29.1 | 29.1 |
| Water addition to upper conduit section 16 | 14.1 | 7 |
| Water addition to chamber 20 | 13.9 | 5 |
| Water addition to chamber 22 | 9.5 | 2.5 |
| Water addition to chamber 24 | 1 | 1 |
| Approximate final moisture content (weight percent) | 44 | 36 |

The "approximate final moisture content" shown above will vary somewhat depending upon the moisture content of the stems before initial moisturizing.

EXAMPLES 2–5

In Examples 2 through 5, the process was carried out under the following constant process conditions. The stems, at an initial moisture content, were moisturized to the first induced moisture content above 20 weight percent by continuous passage of the stems through the inclined rotating cylinder 60 of moisturizing section 80. The stem residence time within cylinder 60 was less than one minute and both water and steam were applied to the stems to achieve the moisture content in excess of 20% and a stem temperature in excess of 120° F.

The stems were thereafter equilibrated (bulked) by confining them within a closed container for 15 minutes. Subsequently, the stems were passed through vertical conduit 10 in which hot water (170°–180° F) was initially applied to the stems and subsequently a mixture of water and steam was applied to the stems in order to achieve the second induced moisture content. The moisture contents of the stems are disclosed in the Examples as: an Initial Moisture Content, entering element 60 in section 80; a First Induced Moisture Content exiting section 80 prior to the equilibration (bulking) in section 82; and, a Second Induced Moisture Content of the stems as they exit the conduit 10 in section 84. The temperature of the stems was increased in all Examples to greater than 195° F. The present invention is compared to the Final Moisture Content of a Control process where the stems are moisturized by conventional techniques to illustrate the benefit of the present invention.

EXAMPLE 2.

In this example, the variation of the moisture level of the stems at various process steps is compared with a prior art process. This example illustrates the more uniform moisture content of tobacco stems and particles treated by the present invention.

Aged flue-cured stems were moisturized in the preferred process and the moisture variations compared to a control process using the same type of stems.

| | Initial Moisture Content of Stems | At First Induced Moisture Content (without bulking) | At Second Induced Moisture Content | Final Moisture Content for Control |
|---|---|---|---|---|
| Mean | 8.84 | 23.52 | 34.4 | 32.9 |
| Standard Deviation | 0.937 | 5.01 | 2.32 | 6.31 |
| 95% C.L. | ±0.7 | ±3.6 | ±1.9 | ±4.9 |

The 95% C.L. (95% Confidence Limits) establishes that the mean moisture of the stem population lies within those limits at a 95% probability level. It is a direct indication of the variation of the moisturized stems and is derived from the deviations from the mean.

As the example illustrates, the stems at the second induced moisture content using the present invention are more uniformly moisturized than those of the prior art process. This significantly improves the overall process of forming expanded tobacco particles by reducing the amount of meal and fines produced in cutting the moisturized stems.

EXAMPLE 3

The same stems as in Example 1 were used in this example produce stems with a higher second induced moisture content.

| | Initial Moisture Content of Stems | At First Induced Moisture Content (without) bulking) | At Second Induced Moisture Content | Final Moisture Content for Control |
|---|---|---|---|---|
| Mean | 9.20 | 32.84 | 41.6 | 40.8 |
| Standard Deviation | 0.745 | 4.854 | 1.404 | 5.345 |
| 95% C.L. | ±0.6 | ±3.5 | ±1.2 | ±4.1 |

EXAMPLE 4

Aged flue-cured stems were moisturized in the same manner as previous examples except the moisture content after bulking in portion 80 of FIG. 3 is used for comparison purposes.

| | Moisture Content After Bulking | Second Induced Moisture Content | Final Moisture Content for Control |
|---|---|---|---|
| Mean | 28.94 | 32.91 | 32.9 |
| Standard Deviation | 2.995 | 2.272 | 6.31 |
| 95% C.L. | ±2.1 | ±1.7 | ±4.9 |

EXAMPLE 5

Aged Burley stems were moisturized in the same manner as stems of Example 4 yielding the following illustrative results:

| | Moisture Content After Bulking | Second Induced Moisture Content | Final Moisture Moisture Content for Control |
|---|---|---|---|
| Mean | 29.48 | 36.90 | 29.1 |
| Standard Deviation | 2.45 | 1.78 | 5.69 |
| 95% C.L. | ±1.7 | ±1.5 | ±4.4 |

The invention has been disclosed in terms of a method and a preferred embodiment for carrying out that method. The scope of the invention is not to be limited to the embodiment depicted. One skilled in the art can modify the embodiment disclosed or use other means to carry out the process steps without departing from the scope of the invention as defined by the appended claims.

What is claimed is:

1. A system for uniformly moisturizing whole tobacco stems comprising:

a. means for opening the cellular structure of said stem;

b. initial moisturizing means for inducing moisture into said cellular structure to a first induced moisture content;

c. means for receiving said stems at said first induced moisture content and thereafter equilibrating the moisture content within said stems; and, d. secondary moisturizing means for moisturizing said equilibrated stems to a second induced moisture content, said second moisturizing means initially applying water and thereafter a mixture of water and steam to said stems, said secondary moisturizing means including:

a substantially vertical conduit having permeable walls, said conduit receiving and passing said stems therethrough;

means associated with the upper portion of said conduit for applying water to said stems within said upper portion;

means for applying a mixture of steam and water to the outer surface of said conduit below said upper portion, said mixture passing through said permeable walls to permeate said stems within said conduit; and, means for preventing localized application of said steam to said outer surface.

2. The system of claim 1 wherein the means for opening the cellular structure of said stems and said initial moisturizing means comprise an inclined rotating cylinder for receiving said stems at the upper end thereof, means for directing steam to a limited portion of said stems within said cylinder and means for directing water to a limited portion of said stems within said cylinder.

3. The system of claim 2 wherein said initial moisturizing means includes a steam pipe at the lower extremity of said cylinder for directing steam onto said stems and a spray nozzle adjacent said steam pipe for directing water onto said stems.

4. The system of claim 3 wherein said spray nozzle and said steam pipe are concurrently directed to the same limited portion of the stems.

5. The system of claim 4 with said limited portion of said stems being approximately one-third of the length of said cylinder from said lower extremity.

6. The system of claim 2 wherein said cylinder is inclined approximately seven degrees from horizontal.

7. The system of claim 2 wherein said equilibrating means comprise a moisture impervious container for confining said stems.

8. An apparatus for uniformly moisturizing whole tobacco stems comprising:

a. a substantially vertical conduit having upper and lower portions, said lower portions having permeable walls, said conduit receiving and passing said stems therethrough;

b. means for feeding said stems to the upper portion of said conduit;

c. means associated with the upper portion of said conduit for applying water to said stems within said upper portion;

d. means defining a plurality of chambers surrounding the lower portion of said conduit, said chambers being located in vertically spaced positions;

e. means for supplying water and steam to said chambers;

f. means interposed between said supply means and the outer surface of said conduit for preventing localized application of said steam to said outer surface; and g. means for conveying said stems from the lower portion of said conduit.

9. The apparatus of claim 8 wherein said stems accumulate and move through the lower portion of said conduit in the form of a column, said upper portion of said conduit including at least one means for sensing the upper level of the column of stems, said sensing means being disposed below said water applying means.

10. The apparatus of claim 9 including control means associated with said sensing means, said control means controlling the height of said column of stems.

11. The apparatus of claim 10 wherein said control means interacts with the means for feeding said stems to the upper portion of said conduit.

12. The apparatus of claim 10 wherein said control means interacts with the means for conveying said stems from the lower portion of said conduit.

13. The apparatus of claim 8 including means in flow communication with the upper portion of said conduit for extracting steam therefrom.

14. The apparatus of claim 8 wherein said means for conveying said stems from the lower portion of said conduit comprises an enclosed conveyor, said conveyor including means for extracting steam therefrom.

15. An improvement in an apparatus for moisturizing whole tobacco stems, said improvement comprising:

a. a substantially vertical conduit having upper and lower portions, said lower portion having permeable walls, said conduit receiving and passing said stems therethrough;

b. means associated with the upper portion of said conduit for applying water to said stems within said upper portion;

c. means for supplying steam and water to the outer surface of the lower portion of said conduit, said water and steam passing through said permeable walls to permeate said stems within said conduit; and d. means interposed between the means for supplying said steam and said outer surface of said conduit for preventing localized application of said steam to said outer surface.

16. The improvement of claim 15 wherein said upper portion of said conduit includes at least one water inlet for applying water to said stems.

17. The improvement of claim 15 wherein said conduit is circular in cross-section and the lower portion is comprised of walls having a plurality of orifices therein disposed along the length of said conduit, said orifices rendering said walls permeable to the passage of said water and steam therethrough.

18. The improvement of claim 17 wherein said orifices are circular and comprise approximately 35 percent of the surface area of the walls of the lower portion of said conduit.

19. The improvement of claim 15 wherein the means for supplying the mixture of water and steam include a plurality of chambers disposed along the length of the lower portion of said conduit, said chambers surrounding said conduit and in flow communication with said stems through said permeable walls, and means for introducing said steam and water to said chambers.

20. The improvement of claim 19 wherein said conduit is cylindrical with said chambers being defined by a substantially concentric member surrounding said conduit and a plurality of radially disposed separating members connecting said concentric member and said conduit.

21. The improvement of claim 20 wherein said apparatus includes three chambers.

22. The improvement of claim 20 wherein said means for preventing localized application of steam to said outer surface comprise baffles interposed between the means for supplying said steam and said outer surface, said baffles allowing flow of said steam around said baffles and through said permeable walls.

23. The improvement of claim 22 wherein said baffles have a height less than said chambers.

24. The improvement of claim 15 wherein said means for preventing localized application of steam to said outer surface comprise baffles interposed between the means for supplying steam supply and said outer surface, said baffles allowing flow of said steam around said baffles and through said permeable walls.

25. The improvement of claim 24 wherein said conduit is cylindrical with said baffles being substantially concentric with said conduit.

26. A method for uniformly moisturizing whole tobacco stems comprising the steps of:

a. opening the cellular structure of said stems;

b. inducing moisture into said cellular structure in an amount in the range of from 20 to 40 weight percent, said range comprising a first induced moisture content;

c. equlibrating the moisture content of said stems; and d. moisturizing said equilibrated stems to a second induced moisture content in the range of from 30 to 60 percent by initially spraying said equilibrated stems with water and thereafter applying a mixture of water and steam to said stems.

27. The method of claim 26 including an additional equilibration step subsequent to the step of moisturizing said stems to said second induced moisture content.

28. The method of claim 26 wherein the step of moisturizing said stems to said second induced moisture content comprises passing said stems through a vertically disposed conduit, initially introducing water to said stems in the upper portion of said conduit and thereafter applying a mixture of water and steam to said stems in the lower portion of said conduit.

29. The method of claim 28 wherein the step of introducing water to said stems in the upper portion of said conduit utilizes water at a temperature of approximately 180° F.

30. The method of claim 28 wherein the step of applying said mixture to said stems includes introducing mixtures of water and steam in differing amounts to separate portions of the lower portion of said conduit.

31. The method of claim 30 including the step of increasing the temperature of said stems as said stems progress through said conduit.

32. The method of claim 30 including the step of extracting the steam from said conduit.

33. The method of claim 28 wherein the step of initially introducing water to said stems increases the moisture content of said equilibrated stems approximately 10 percent.

34. The method of claim 33 wherein the step of moisturizing said stems to said second induced moisture content includes applying said mixture to said conduit at three spacially separate portions along the length of said conduit, the uppermost portion of said conduit receiving said mixture at a flow rate sufficient to increase the moisture content of said stems approximately three percent, the middle portion of said conduit receiving said mixture at a flow rate sufficient to increase the moisture content of said stems approximately one percent and the lowermost portion of said conduit receiving said mixture at a flow rate sufficient to increase the moisture content of the stems less than one percent achieving the desired second induced moisture content.

35. The method of claim 34 wherein the final moisture content of individual stems varies from the average moisture content of said stems less than 2%.

36. The method of claim 28 wherein the step of initially introducing water to said stems increases the moisture content of said equilibrated stems approximately 5 percent.

37. The method of claim 36 wherein the step of moisturizing said stems to said second induced moisture content includes applying said mixture to said conduit at three spacially separate portions along the length of said conduit, the uppermost portion of said conduit receiving said mixture at a flow rate sufficient to increase the moisture content of said stems approximately one percent, the middle portion of said conduit receiving said mixture at a flow rate sufficient to increase the moisture content of said stems less than one percent and the lowermost portion of said conduit receiving said mixture at a flow rate sufficient to increase the moisture content of the stems less than one percent achieving the desired second induced moisture content.

38. The method of claim 28 wherein the step of passing said stems through said conduit results in said stems being within said conduit an average residence time in the range of from about 2 to 6 minutes.

39. The method of claim 28 wherein the step of applying said mixture to said stems utilizes a mixture of water and steam at a temperature in the range of from 200° to 212° F.

40. The method of claim 28 wherein the stems free fall through the upper portion of the conduit and move as a column through the lower portion of the conduit.

41. The method of claim 26 wherein said mixture of water and steam comprises water at a temperature of from 40 to 70° F and steam at 15 psig.

42. The method of claim 26 wherein the step of moisturizing said stems to a second induced moisture content results in said stems having an average moisture content of approximately 32 to 44 weight percent.

43. The method of claim 26 wherein the moisturizing of the equilibrated stems to the final desired level is accomplished in stages of ever decreasing amounts to trim the moisture content to the desired level while effecting a uniform diffusion of moisture throughout the stems and from stem to stem.

* * * * *